US008055157B2

(12) United States Patent
Adachi

(10) Patent No.: US 8,055,157 B2
(45) Date of Patent: Nov. 8, 2011

(54) ION GENERATING ELEMENT, CHARGING DEVICE AND IMAGE FORMING APPARATUS

(75) Inventor: Katsumi Adachi, Ikoma-gun (JP)

(73) Assignee: Sharp Kabushiki Kaisha, Osaka (JP)

( * ) Notice: Subject to any disclaimer, the term of this patent is extended or adjusted under 35 U.S.C. 154(b) by 375 days.

(21) Appl. No.: 12/391,485

(22) Filed: Feb. 24, 2009

(65) Prior Publication Data

US 2009/0220279 A1 Sep. 3, 2009

(30) Foreign Application Priority Data

Feb. 29, 2008 (JP) ..... 2008-050644
Jun. 4, 2008 (JP) ..... 2008-146851

(51) Int. Cl.
*G03G 15/02* (2006.01)
*G03G 15/16* (2006.01)

(52) U.S. Cl. ..... 399/168; 361/225; 399/296; 399/310

(58) Field of Classification Search ..... 399/168, 399/310, 296, 302, 308; 361/225
See application file for complete search history.

(56) References Cited

U.S. PATENT DOCUMENTS

| | | | | |
|---|---|---|---|---|
| 4,783,716 | A * | 11/1988 | Nagase et al. | 361/225 |
| 5,367,366 | A | 11/1994 | Kido et al. | 399/315 |
| 5,983,060 | A | 11/1999 | Namekata et al. | 399/297 |
| 2009/0039244 | A1 * | 2/2009 | Kagawa et al. | 399/168 X |

FOREIGN PATENT DOCUMENTS

| | | | |
|---|---|---|---|
| JP | 61-289365 | A | 12/1986 |
| JP | 63-159883 | | 7/1988 |
| JP | 64-007071 | | 1/1989 |
| JP | 08-160711 | | 6/1996 |
| JP | 09-305001 | | 11/1997 |
| JP | 10-294163 | A | 11/1998 |
| JP | 11-72990 | A | 3/1999 |
| JP | 11-194581 | | 7/1999 |
| JP | 2001-093651 | | 4/2001 |
| JP | 2002-237368 | | 8/2002 |
| JP | 2003-249327 | | 9/2003 |
| JP | 2004-069860 | | 3/2004 |
| JP | 2004-157447 | | 6/2004 |
| JP | 2006-22019 | A | 8/2006 |
| JP | 2006-222019 | A | 8/2006 |

OTHER PUBLICATIONS

U.S. Appl. 12/480,850, filed Jun. 9, 2009, entitled "Ion Generating Element, Charging Device, and Image Forming Apparatus".

* cited by examiner

*Primary Examiner* — Sophia S Chen
(74) *Attorney, Agent, or Firm* — Nixon & Vanderhye P.C.

(57) ABSTRACT

An ion generating element of the present invention includes a discharge electrode and an inductive electrode, both of which are provided so as to face each other with a dielectric body sandwiched therebetween, and a heater electrode which warms the ion generating element by Joule heat produced because of a passage of an electrical current. A distance between the discharge electrode and the heater electrode is larger than that between the discharge electrode and the inductive electrode, and further a shield electrode having a connection for ground is provided between the heater electrode and the inductive electrode on a surface of the dielectric body at a side on which the inductive electrode is provided. Hence, it is possible to prevent a leak to the heater electrode at low cost, while giving consideration towards safety.

11 Claims, 10 Drawing Sheets

ION GENERATING ELEMENT, CHARGING DEVICE AND IMAGE FORMING APPARATUS

This Nonprovisional application claims priority under 35 U.S.C. §119(a) on Patent Application No. 2008-050644 filed in Japan on Feb. 29, 2008, and Patent Application No. 2008-146851 filed in Japan on Jun. 4, 2008, the entire contents of which are hereby incorporated by reference.

1. Technical Field

The technology disclosed herein relates to: an ion generating element, included in an image forming apparatus such as a copying machine, a printer, and a facsimile, for use in an image forming process in which an electrostatic latent image formed on an image bearing member is developed by toner and then transferred onto and fixed on a print medium; a charging device including the ion generating element; and an image forming apparatus including the ion generating element.

More specifically, the technology disclosed herein relates to: an ion generating element, in which a discharge electrode and an inductive electrode are positioned on front and back sides of a dielectric body, for applying a high alternating voltage across the electrodes to generate creeping discharge and to take out ions having a desired polarity so that (i) a charge receiving material (such as a photoreceptor) is charged, and that (ii) a toner image on an image bearing member (such as the photoreceptor and an intermediate transfer body) is charged before it is transferred to a transfer receiving body (such as the intermediate transfer body and recording paper); and to a charging device including the ion generating element. The technology disclosed herein also relates to an image forming apparatus including the charging device.

2. Background Art

Conventionally, in an image forming apparatus that employs an electrophotographic printing method, a charging device that employs a corona discharge system has been often used in, for example, a charging device for charging a photoreceptor, a transfer device for electrostatically transferring, to recording paper or the like, a toner image which is formed on the photoreceptor or the like, and a separation device for separating the recording paper or the like which electrostatically comes into contact with the photoreceptor or the like.

Such a charging device employing the corona discharge system generally includes a shield case having an opening section that faces a charge receiving material such as the photoreceptor and the recording paper, and a discharge electrode of a line or saw-tooth shape which discharge electrode is provided in a tensioned state in the shield case. Examples of this charging device include (a) a corotron that (i) applies a high voltage to the discharge electrode so as to generate corona discharge and, thereby, (ii) uniformly charges a charge receiving material, and (b) a scorotron that (i) applies a desired voltage to a grid electrode provided between a discharge electrode and a charge receiving material and, thereby, (ii) uniformly charges the charge receiving material, which scorotron is disclosed in Japanese Unexamined Patent Publication No. 11946/1994 (Tokukaihei 6-11946) (published on Jan. 21, 1994) (Patent Document 1).

This charging device employing the corona discharge system is used in a pre-transfer charging device for charging a toner image that has not been subjected to transfer to a transfer medium such as an intermediate transfer body, the recording paper, or the like. Examples of such a charging device -are disclosed in Japanese Unexamined Patent Publication No. 274892/1998 (Tokukaihei 10-274892) (published on Oct. 13, 1998) (Patent Document 2) and Japanese Unexamined Patent Publication No. 69860/2004 (Tokukai 2004-69860) (published on Mar. 4, 2004) (Patent Document 3). According to techniques as disclosed in Patent Documents 2 and 3, even if a charge amount is not uniform in the toner image formed on an image bearing member, the charge amount of the toner image is uniformized before the toner image is transferred. Therefore, it becomes possible to suppress a decrease in a transfer margin at the time of transferring a toner image, and also to stably transfer the toner image to a transfer medium.

However, the conventional charging device described above has a plurality of problems. First, the charging device requires not only the discharge electrode but also the shield case, the grid electrode, and the like. Further, it is necessary to ensure a constant distance (10 mm) between the discharge electrode and the charge receiving material. As a result, a large space becomes necessary for providing the charging device. Generally, a developing device, a first transfer device, and the like are provided around a first transfer section, and the photoreceptor, a second transfer device, and the like are provided in front of a second transfer section. Accordingly, a space for the pre-transfer charging device is small. Therefore, in the conventional charging device employing the corona discharge system, it is difficult to lay out the members.

Secondly, the conventional charging device employing the corona discharge system generates a large amount of discharge products such as ozone ($O_3$) and nitrogen oxide (NOx). Generation of a large amount of ozone causes (i) ozone smell, (ii) a harmful influence on a human body, (iii) deterioration of members due to strong oxidation power, and the like. Further, when nitrogen oxide is generated, nitrogen oxide as ammonium salt (ammonium nitrate) adheres to the photoreceptor. This causes a defect in an image. Especially an organic photoreceptor (OPC) that is commonly used tends to cause a defect in an image, for example, a white spot or an image deletion because of ozone, NOx or the like.

In view of uniformity of a charge amount of a toner image that has not been subjected to transfer, a color image forming apparatus, which employs an intermediate transfer system and includes a plurality of transfer sections, preferably has an arrangement in which pre-transfer charging device is provided upstream with respect to each of the transfer sections (a plurality of the first transfer sections, and a second transfer section). However, this is practically difficult in consideration of generation amounts of ozone and NOx.

Furthermore, for the purpose of eliminating ozone, in recent years, a charging device employing a contact electrification system has been used as a charging device for charging the photoreceptor itself. In the contact electrification system, a conductive roller or a conductive brush carries out contact electrification. However, when employing the contact electrification system, it is difficult to carry out charging without damaging the toner image. Accordingly, the corona discharge system which is a non-contact system is used for the pre-transfer charging device. However, in a case where the pre-transfer charging device employing the conventional corona discharge system is provided to the image forming apparatus using the contact electrification system, a characteristic of being ozone free cannot be achieved.

As a technique for reducing a generation amount of ozone, for example, Japanese Unexamined Patent Publication No. 160711/1996 (Tokukaihei 8-160711) (published on Jun. 21, 1996) (Patent Document 4) discloses a charging device including: a large number of discharge electrodes arranged at a substantially equal pitch in a predetermined axial direction; a high voltage power source for applying, to the discharge electrodes, a voltage equal to or higher than a voltage for starting discharge; a resistor provided between an output electrode of the high voltage power source and the discharge electrodes; a grid electrode provided in the vicinity of the discharge electrodes and between the discharge electrodes and the charge receiving material; and a grid power source for applying a grid voltage to the grid electrode. This charging device reduces a generation amount of ozone, by having an arrangement in which a gap between the discharge electrodes and the grid electrode is set to be equal to or less than 4 mm so as to reduce a discharge current.

According to the technique disclosed in Patent Document 4, a generation amount of ozone can be reduced by reduction in the discharge current. However, because the reduction of generation of ozone is not sufficient, approximately 1.0 ppm of ozone is still generated. Further, there is another problem such that discharge may become unstable due to adherence of discharge products, toner, paper powder, or the like to the discharge electrode, or abrasion/deterioration of a tip of the discharge electrode due to discharge energy. Furthermore, a shape of the discharge electrode makes it difficult to clean off the discharge products, the toner, or the paper powder from the discharge electrode.

Moreover, a narrow gap between the discharge electrode and the charge receiving material easily causes non-uniformity of electrification in a longitudinal direction (a direction of the pitch of the discharge electrodes) due to the pitch of the plurality of the discharge electrodes. Here, a shorter pitch of the discharge electrodes may improve the non-uniformity of electrification. However, this increases the number of the discharge electrodes, thereby increasing production cost.

In order to solve the problems of the conventional charging device, for example, Japanese Unexamined Patent Publication No. 249327/2003 (Tokukai 2003-249327) (published on Sep. 5, 2003) (Patent Document 5) discloses a charging device including an ion generating element (a creeping discharge element) which is provided with a discharge electrode having pointed protrusions on a periphery of the discharge electrode and an inductive electrode in a manner such that the discharge electrode and the inductive electrode sandwich a dielectric body, and which generates ions according to application of a high alternating voltage across the discharge electrode and the inductive electrode (hereinafter, this charging system is referred to as a creeping discharge system).

The charging device employing this creeping discharge system is small in size, because the charging device does not have a shield case, a grid electrode, and the like. Further, cleaning of the charging device is easy because a discharging surface of the charging device is flat. Therefore, the charging device also has an advantage in easiness of maintenance.

Here, discharge characteristics of the ion generating element (the creeping discharge element) tend to decline under a high humidity condition. In view of this problem, for example, Japanese Unexamined Patent Publication No. 157447/2004 (Tokukai 2004-157447) (published on Jun. 3, 2004) (Patent Document 6) and Japanese Unexamined Patent Publication No. 237368/2002 (Tokukai 2002-237368) (published on Aug. 23, 2002) (Patent Document 7) disclose a technique for improving the discharging characteristics by providing the ion generating element with a heater member and heating the element to remove absorption moisture in the discharge area. Especially, Patent Document 7 discloses a technique in which an inductive electrode is electrified to generate Joule heat, thereby doubling as a heater. With this technique disclosed in Patent Document 7, it becomes possible to make the ion generating element more compact and to reduce costs than with the technique of providing an additional heater element independently.

SUMMARY OF INVENTION

However, there is following problem in a case of the ion generating element having a heater line as described above. For example, if an element breaks due to an unexpected accident or due to insufficient insulation performance between the high voltage line and the heater line caused by unbalanced quality at a time of manufacture, there is a risk that a leak may occur from the high voltage line to the heater line. This as a result may cause (i) damage to a heater power source, (ii) a breakdown of a machine including the ion generating element, or (iii) an ignition accident.

Here, in the case where the element breaks, a leak to the inductive electrode provided closest to the discharge electrode occurs first. FIG. 7(*a*) illustrates an ion generating element including an electrode which doubles as an inductive electrode and a heater electrode, as described in Patent Document 7. In such an arrangement, the heater power source 34 has a high risk of receiving damage in occurrence of the leak. It is also the case with an ion generating element in which the inductive electrode 23 and the heater electrode 25 are provided independently as illustrated in FIG. 7(*b*), that the leak to the inductive electrode 23 provided closest to the discharge electrode 22 occurs first when the element breaks. Meanwhile, a leak may also occur to the heater electrode 25, depending on (i) an applied voltage to the discharge electrode 22, (ii) a distance between the discharge electrode 22 and the heater electrode 25, and (iii) a state of a broken surface. Moreover, an occurrence of the leak while discharge is carried out, in a case where the upper dielectric body 21*a* is made of resin or the like, causes the resin to melt. This melted resin blocks a leak path to the inductive electrode 23. Suppression in generation of ozone or the like is attained by providing the inductive electrode 23 in a line-shape, such that a discharge region width is made narrow. However, if a line width is narrow, there is a high possibility that the leak path becomes blocked. As a result, the leak from the discharge electrode 22 flows to the heater electrode 25. This may cause damage to the heater power source 34 including the ion generating element.

In order to prevent such situation, the following method may be considered for example: a method in which a dielectric body consists of three to four layers, and which a heater electrode is provided on a lower side (opposite side of a discharge electrode) of an inductive electrode layer so as to provide a large distance between the discharge electrode and the heater electrode. For example, Japanese Unexamined Patent Publication No. 305001/1997 (Tokukaihei 9-305001) (published on Nov. 28, 1997) (Patent Document 8) discloses an arrangement of an ion generating element, in which a heater electrode is provided on an opposite side of the inductive electrode via a ceramic substrate, and further is provided with an adhesive layer and a binder layer on a front side of the heater electrode.

However, an objective of the technique in Patent Document 8 is to prevent scattering and losing of fragments of the upper dielectric body and the ceramic substrate inside the image forming apparatus by use of the adhesive layer and the binder layer, even if a ceramic substrate or glass of an upper dielectric body is broken. In view of prevention of leak to the heater electrode, it is required to ensure an insulation distance by a thickness of the ceramic substrate. However, the thickness of the ceramic substrate is 0.5 mm, which is not sufficient enough. As such, this technique is not intended to be used as a measure against the leak to the heater electrode. Even if such multilayer arrangement is adopted, the dielectric body provided between the inductive electrode and the heater electrode requires having a considerable thickness so as to ensure an insulation performance, and requires high cost due to complexity in layer arrangement.

The technology disclosed herein is attained in view of the problems, and its object is to provide an ion generating element for generating ions in conjunction with creeping discharge, a charging device, and an image forming device, each of which is capable of preventing a leak to a heater electrode at low cost, and which gives safety into consideration.

In order to attain the object, an ion generating element of the technology disclosed herein generates ions in conjunction with creeping discharge by applying a voltage so that a potential difference is given between a discharge electrode and an inductive electrode, the discharge electrode and the inductive electrode being provided so as to sandwich a dielectric body therebetween, the ion generating element including: a heater electrode for warming the ion generating element by Joule heat produced because of a passage of an electrical current, the heater electrode being provided, on the surface of the dielectric body at a side on which the inductive electrode is provided, so that a distance between the discharge electrode and the heater electrode is larger than that between the discharge electrode and the inductive electrode; and a shield electrode, having a connection for ground, and provided between the heater electrode and the inductive electrode on a surface of the dielectric body at the side on which the inductive electrode is provided.

According to the arrangement, a heater electrode is provided on a same surface as a surface of the dielectric body at a side on which an inductive electrode is provided, and further a shield electrode having a connection for ground is provided between the inductive electrode and the heater electrode. When a breakage in the ion generating element 1 occurs, which causes a leak path to generate, although the leak path to the inductive electrode is blocked, the shield electrode is subsequently subjected to a leak. The shield electrode is connected to a ground potential via the connection for ground, which causes a leak current to flow to ground. Thus, it is possible to prevent the leak to the heater electrode. Here, it is preferable to provide a shield electrode which has a width wider than that of the inductive electrode, even in view of ensuring a shielding function. Since the leak to the heater electrode is prevented, damage to the heater power source would not occur; breakage of a machine including the ion generating element and occurrence of an ignition accident are also prevented. Thus, it is possible to provide an ion generating element which gives safety into consideration.

Moreover, the inductive electrode and the heater electrode are provided on a same surface of the dielectric body, and the shield electrode is provided between the inductive electrode and the heater electrode. Thus, an insulation distance is easily provided in a plane direction of the dielectric body. Therefore, there is no need to use a thick dielectric body in order to provide a distance between the discharge electrode and the heater electrode. Furthermore, an electrode layer is made of two layers (the discharge electrode, and the inductive electrode, the heater electrode and the shield electrode), arranged in such a manner that the dielectric body is sandwiched between the two layers. Hence, the arrangement is simple, which allows easy arrangement at low cost.

For a fuller understanding of the nature and advantages of the invention, reference should be made to the ensuing detailed description taken in conjunction with the accompanying drawings.

BRIEF DESCRIPTION OF DRAWINGS

FIG. 1(*a*) is a plan view illustrating an embodiment of an ion generating element according to the technology disclosed herein.

FIG. 1(*b*) is a cross sectional view of the ion generating element illustrated in FIG. 1(*a*).

FIG. 2 is an explanatory view illustrating an arrangement of an essential part of an image forming apparatus according to the technology disclosed herein.

FIG. 3(*a*) is a view illustrating an arrangement of a charging device according to the technology disclosed herein.

FIG. 3(*b*) is a cross sectional view of an ion generating element connected to a power source.

FIG. 4(*a*) is an explanatory view illustrating occurrence of a leak from a discharge electrode.

FIG. 4(*b*) is an explanatory view illustrating occurrence of a leak from a discharge electrode.

FIG. 5(*a*) is a plan view illustrating another example of an ion generating element according to the technology disclosed herein.

FIG. 5(*b*) is a B-B' cross sectional view illustrating the ion generating element illustrated in FIG. 5(*a*).

FIG. 6 is a front elevational view illustrating still another example of an ion generating element according to the technology disclosed herein.

FIG. 7(*a*) is a plan view of a conventional ion generating element used as a comparative example.

FIG. 7(*b*) is a plan view of a conventional ion generating element used as another comparative example.

FIG. 7(*c*) is a C-C' cross sectional view of the ion generating element illustrated in FIG. 7(*a*).

FIG. 7(*d*) is a D-D' cross sectional view of the ion generating element illustrated in FIG. 7(*b*).

FIG. 8 is a front elevational view illustrating still another example of an ion generating element according to the technology disclosed herein.

FIG. 9 is a front elevational view illustrating still another example of an ion generating element according to the technology disclosed herein.

DESCRIPTION OF EMBODIMENTS

Embodiment

The following specifically explains one embodiment of an ion generating element according to the technology disclosed herein, a charging device according to the technology disclosed herein including such an ion generating element, and an image forming apparatus including the charging device with reference to FIGS. 1 through 6. Note that the following embodiment is an example that specifically explains the technology disclosed herein, and does not limit the technical scope of the technology disclosed herein.

Figure 2:
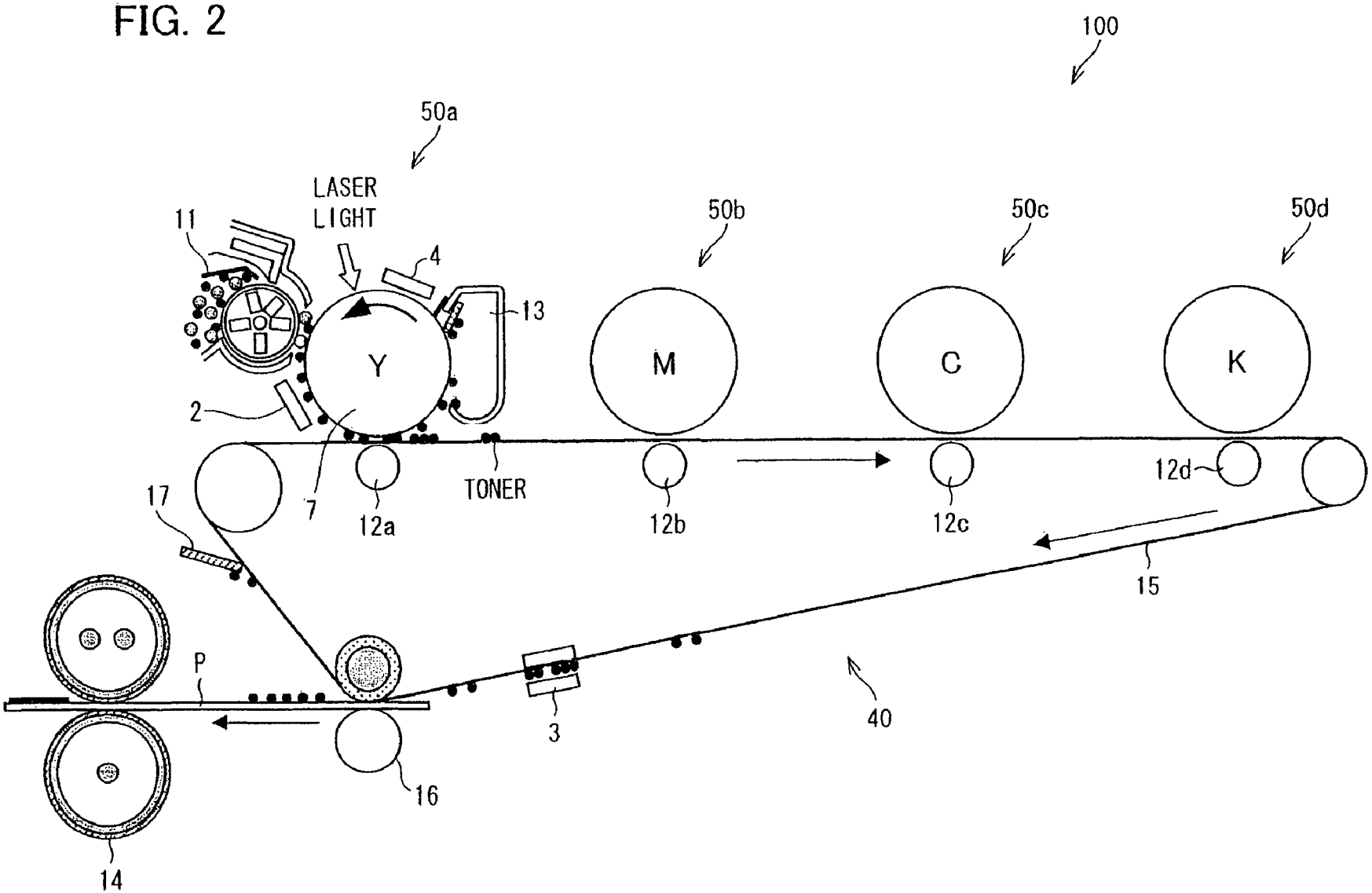
FIG. 2

First, the following explains a whole arrangement of the image forming apparatus of the present embodiment. FIG. 2 is a cross sectional view schematically illustrating an arrangement of an image forming apparatus 100 including a pre-transfer charging device of the present embodiment. This image forming apparatus 100 is a tandem type printer employing an intermediate transfer system, and can form a full color image.

As illustrated in FIG. 2, the image forming apparatus 100 includes visible image forming units 50*a* to 50*d* for four colors (C, M, Y, and K), a transfer unit 40, and a fixing device 14.

The transfer unit 40 includes an intermediate transfer belt 15 (an image bearing member), four first transfer devices 12*a* to 12*d* provided around the intermediate transfer belt 15, a second pre-transfer charging device 3, a second transfer device 16, and a transfer cleaning device 17.

Toner images of the colors visualized by the visible image forming units 50*a* to 50*d* are overlapped on and transferred to the intermediate transfer belt 15. The intermediate transfer belt 15 further transfers the transferred toner images to recording paper P. Specifically, the intermediate transfer belt 15 is a belt that has no end, and is suspended in a tensioned state by a pair of driving rollers and an idle roller. At the time of forming an image, conveyance driving is subjected to the intermediate transfer belt 15 under control at a predetermined peripheral velocity (in the present embodiment, in a range of 167 mm/s to 225 mm/s).

The first transfer devices 12*a* to 12*d* are provided to the visible image forming units 50*a* to 50*d*, respectively. The toner image is transferred to the intermediate transfer belt 15 by applying, to the first transfer devices 12*a* to 12*d*, a bias voltage whose polarity is opposite to that of the toner image formed on a surface of a photoreceptor drum 7. Each of the first transfer devices 12*a* to 12*d* is positioned so as to face corresponding one of the visible image forming units 50*a* to 50*d* via the intermediate transfer belt 15.

The second pre-transfer charging device 3 re-charges the toner image that has been overlapped on and transferred to the intermediate transfer belt 15. In the present embodiment, the second pre-transfer charging device 3 discharges ions so as to charge the toner image, which is explained later in detail.

The second transfer device 16 re-transfers, to the recording paper P, the toner image which has been transferred to the intermediate transfer belt 15. The second transfer device 16 is provided in touch with the intermediate transfer belt 15. The transfer cleaning device 17 cleans a surface of the intermediate transfer belt 15 after the toner image is re-transferred.

Around the intermediate transfer belt 15 of the transfer unit 40, the first transfer units 12*a* to 12*d*, the second pre-transfer charging device 3, the second transfer device 16, and the transfer cleaning device 17 are provided in this order from an upstream side in a carrying direction of the intermediate transfer belt 15.

The fixing device 14 is provided in a downstream side of the second transfer device 16 in a carrying direction of the recording paper P. The fixing device 14 fixes, to the recording paper P, the toner image which has been transferred onto the recording paper P by the second transfer device 16.

Further, the four visible image forming units 50*a* to 50*d* are provided in touch with the intermediate transfer belt 15 along the carrying direction of the intermediate transfer belt 15. The four visible image forming units 50*a* to 50*d* have the same arrangement except that different toner colors are used. The toner colors of the four visible image forming units 50*a* to 50*d* are yellow (Y), magenta (M), cyan (C), and black (K), respectively. The following description deals with only the visible image forming unit 50*a*, and explanations of the other visible image forming units 50*b* to 50*d* are omitted. Accordingly, FIG. 2 illustrates only members of the visible image forming unit 50*a*. However, the other visible image forming units 50*b* to 50*d* also include the same members as the visible image forming unit 50*a*.

The visible image forming unit 50*a* includes the photoreceptor drum 7 (image bearing member), a latent image charging device 4 that is provided in the vicinity of the photoreceptor drum 7, a laser writing unit (not illustrated), a developing device 11, a first pre-transfer charging device 2, a cleaning device 13, and the like.

The latent image charging device 4 charges a surface of the photoreceptor drum 7 to a predetermined electric potential. In the present embodiment, the latent image charging device 4 emits ions so as to charge the photoreceptor drum 7. A detailed explanation of the latent image charging device 4 is given later.

According to image data received from an external device, the laser writing unit irradiates a laser beam on the photoreceptor drum 7 (exposes the photoreceptor drum 7 to the laser beam), and writes, by scanning a light image, an electrostatic latent image on the photoreceptor drum 7 that has been uniformly charged.

The developing device 11 provides toner to the electrostatic latent image that is formed on the surface of the photoreceptor drum 7, so as to form the toner image by developing the electrostatic latent image.

The first pre-transfer charging device 2 re-charges the toner image that is formed- on the surface of the photoreceptor drum 7, before the toner image is transferred. In the present embodiment, the first pre-transfer charging device 2 emits ions so as to charge the toner image. A detailed explanation of the first pre-transfer charging device 2 is given later.

The cleaning device 13 removes and collects residual toner that is left on the photoreceptor drum 7, after the toner image is transferred to the intermediate transfer belt 15. This allows forming of a new electrostatic latent image and a new toner image on the photoreceptor drum 7.

Around the photoreceptor drum 7 of the visible image forming unit 50*a*, the latent image charging device 4, the laser writing unit, the developing device 11, the first pre-transfer charging device 2, the first transfer device 12*a*, and the cleaning device 13 are provided in this order from an upstream side in a rotation direction of the photoreceptor drum 7.

Next, the following explains an image forming operation of the image forming apparatus 100. An operation of the visible image forming unit is explained with reference to members (members having reference numerals) of the visible image forming unit 50*a*. The visible image forming units 50*b* to 50*d* operate in the same manner as the visible image forming unit 50*a*.

First, the image forming apparatus 100 acquires image data from an external device (not illustrated). Moreover, a driving unit (not illustrated) of the image forming apparatus 100 rotates the photoreceptor drum 7 in a direction shown by an arrow illustrated in FIG. 2 at a predetermined velocity (in the present embodiment, in a range of 167 mm/s to 225 mm/s). Simultaneously, the latent image charging device 4 charges the surface of the photoreceptor drum 7 to a predetermined electric potential.

Next, according to the acquired image data, the laser writing unit exposes the surface of the photoreceptor drum 7, and writes, to the surface of the photoreceptor drum 7, an electrostatic latent image corresponding to the image data. Then, the developing device 11 provides toner to the electrostatic latent image that is formed on the surface of the photoreceptor drum 7. As a result, the toner adheres to the electrostatic latent image and a toner image is formed.

The first pre-transfer charging device 2 re-charges this toner image that is formed on the surface of the photoreceptor drum 7. Then, the bias voltage whose polarity is opposite to that of the toner image formed on the surface of the photoreceptor drum 7 is applied to the first transfer device 12*a*. This transfers (a first transfer), to the intermediate transfer belt 15, the toner image that is re-charged by the first pre-transfer charging device 2.

The visible image forming units 50*a* to 50*d* perform the aforementioned operation in turn so that the toner images of four colors Y, M, C, and K are overlapped on the intermediate transfer belt 15 in turn.

The overlapped toner images are carried to the second pre-transfer charging device 3 by the intermediate transfer belt 15. Then, the second pre-transfer charging device 3 re-charges thus carried toner images. Subsequently, the intermediate transfer belt 15 that bears the re-charged toner images is pressed against the recording paper P, which is fed from a paper feeding unit (not illustrated), by the second transfer device 16. Moreover, a voltage whose polarity is opposite to that of toner charge is applied to the intermediate transfer belt 15. As a result, the toner images are transferred to the recording paper P (a second transfer).

Then, the fixing device 14 fixes the toner image to the recording paper P. The recording paper P on which the image has been recorded is ejected to a paper output unit (not illustrated). After the transfer described above, residual toner left on the photoreceptor drum 7 is removed and collected by the cleaning device 13. Further, residual toner left on the intermediate transfer belt 15 is removed and collected by the transfer cleaning device 17. This operation described above allows the image forming apparatus 100 to appropriately perform printing on the recording paper P.

Next, an arrangement of the pre-transfer charging device is explained in detail. The first pre-transfer charging device 2, the latent image charging device 4, and the second pre-transfer charging device 3 that are mentioned above are the same other than that the first pre-transfer charging device 2, the latent image charging device 4, and the second pre-transfer charging device 3 are provided in different positions, respectively. In the latent image charging device 4, a grid electrode for controlling an electric potential of charging may be provided between an ion generating element (a creeping discharge element) 1 explained below and the photoreceptor drum 7. A position of this grid electrode is preferably approximately 1 mm away from the photoreceptor drum 7, and approximately 2 mm to 10 mm away from the ion generating element 1. The following explains the second pre-transfer charging device 3 in detail, but detailed explanations of the first pre-transfer charging device 2 and the latent image charging device 4 are omitted.

Figure 1:
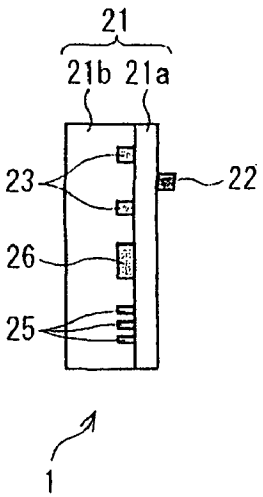
FIG. 1
Figure 1:
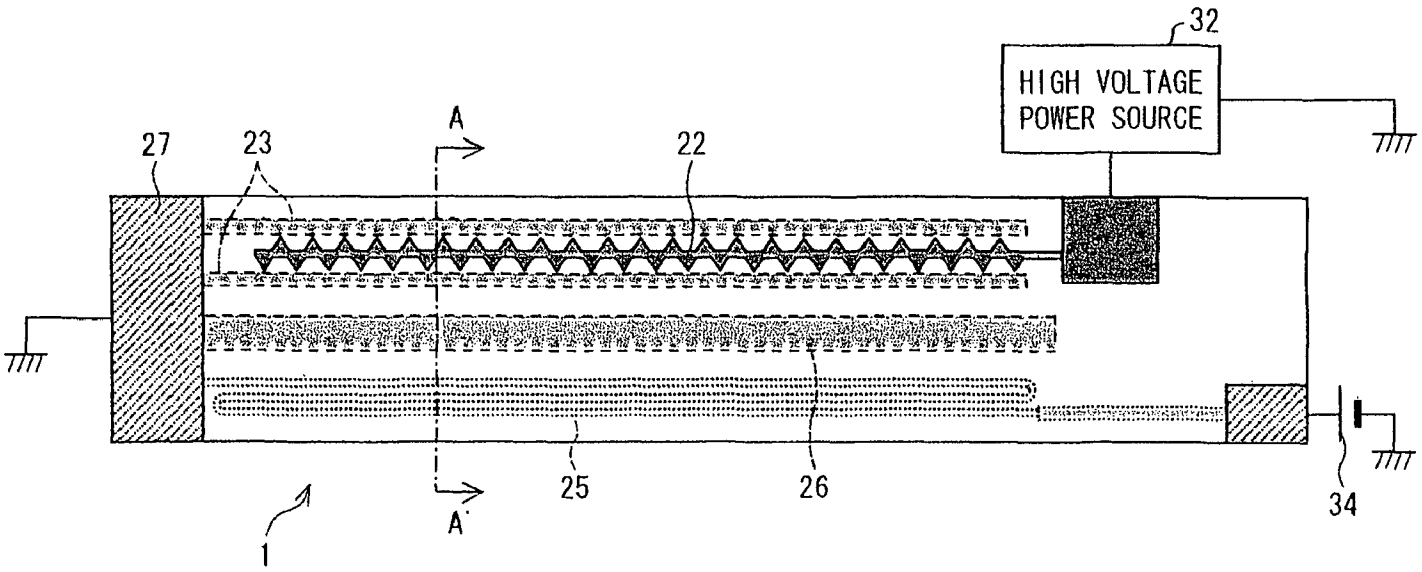
Figure 3:
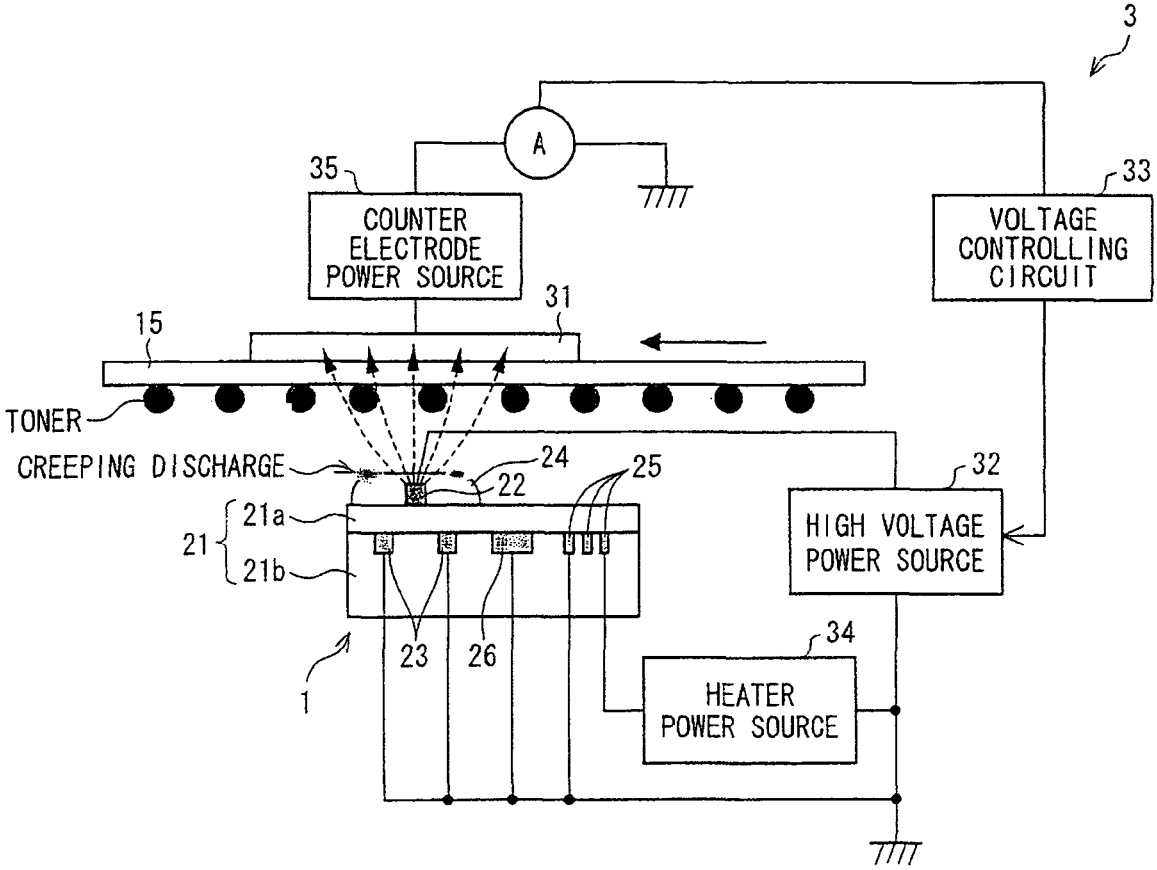
FIG. 3
Figure 3:
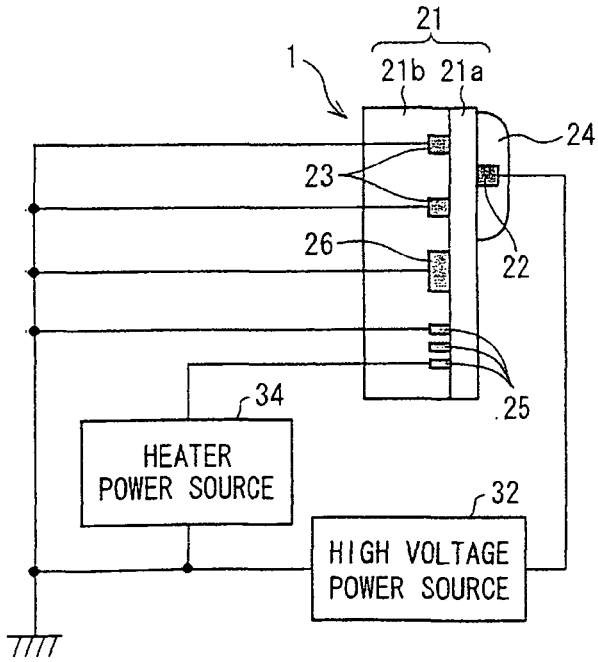

FIG. 3(*a*) is a schematic view of the second pre-transfer charging device 3 positioned in the vicinity of the intermediate transfer belt 15, and FIG. 3(*b*) is a side view of the ion generating element 1 connected to a power source. FIG. 1(*a*) is a front elevational view of the ion generating element 1, and FIG. 1(*b*) is a cross sectional view on line A-A' of the ion generating element 1 of FIG. 1(*a*).

As illustrated in FIG. 3(*a*), the second pre-transfer charging device 3 includes the ion generating element 1, a counter electrode 31, a high voltage power source 32, and a voltage controlling circuit 33.

The ion generating element 1, as illustrated in FIGS. 3(*a*) and 3(*b*), includes a dielectric body 21, a discharge electrode 22, an inductive electrode 23, a coating layer (protective layer) 24, a heater electrode 25, and a shield electrode 26. The ion generating element 1 generates ions by discharge due to an electric potential difference between the discharge electrode 22 and the inductive electrode 23 (corona discharge that is produced in the vicinity of the discharge electrode 22 in a direction along a surface of the dielectric body 21).

The dielectric body 21 is arranged as a flat plate made by bonding an upper dielectric body 21*a* and a lower dielectric body 21*b* that are substantially rectangular. A preferable material of the dielectric body 21 in a case where the dielectric body 21 is made of an organic material is a material that is excellent in oxidation resistance. For example, resin such as polyimide or glass epoxy may be used as the material. In a case where an inorganic material is selected as a material of the dielectric body 21, a mica laminate material, alumina, glass-ceramics, forsterite, and ceramic such as steatite may be used as the material. In terms of corrosion resistance, an inorganic material is more preferable as the material of the dielectric body 21. Further, in terms of formability, easiness in electrode formation later explained, moisture resistance, or the like, ceramic is preferably used in formation of the dielectric body 21. Moreover, it is desirable that an insulation resistance between the discharge electrode 22 and the inductive electrode 23 is uniform. Accordingly, the less a density inside the material of the dielectric body 21 varies and the more uniform an insulation ratio of the dielectric body 21 becomes, the more preferable the dielectric body 21 becomes. A preferable thickness of the dielectric body 21 is 50 μm to 250 μm. However, the thickness is not limited to this value.

The discharge electrode 22 is formed integrally with the dielectric body 21 on a surface of the dielectric body 21 (the upper dielectric body 21*a*). A material of the discharge electrode 22 is not specifically limited as long as the material is electrically conductive, for example, tungsten, silver, or stainless steel. However, the material must not cause deformation such as meltdown or scattering due to discharge. It is preferable that the discharge electrode 22 has a uniform depth from a surface of the dielectric body 21 (in a case where the discharge electrode 22 is provided toward the inductive electrode 23 from the surface of the dielectric body 21) or a uniform thickness from the surface of the dielectric body 21 (in a case where the discharge electrode 22 is provided so as to protrude from the surface of the dielectric body 21). In the present embodiment, tungsten or stainless steel is used as the materials of the discharge electrode 22.

A shape of the discharge electrode 22 may be any shape as long as the shape extends evenly in a direction orthogonal with respect to a direction in which the intermediate transfer belt 15 moves. However, it is more preferable to have a shape that easily causes electric field concentration between the discharge electrode 22 and the inductive electrode 23, if possible. This is because such a shape allows discharge between the discharge electrode 22 and the inductive electrode 23 to be produced even in a case where a low voltage is applied between the discharge electrode 22 and the inductive electrode 23. In the present embodiment, the shape of the discharge electrode 22 has a comb-tooth shape as illustrated in FIG. 1(*a*) so that discharge is easily produced. In the present embodiment, the discharge electrode 22 has a comb-tooth shape, however, a rectangular shape extending in a longitudinal direction of the dielectric body 21 is also applicable as in arrangements illustrated in FIGS. 5 and 6.

Figure 6:
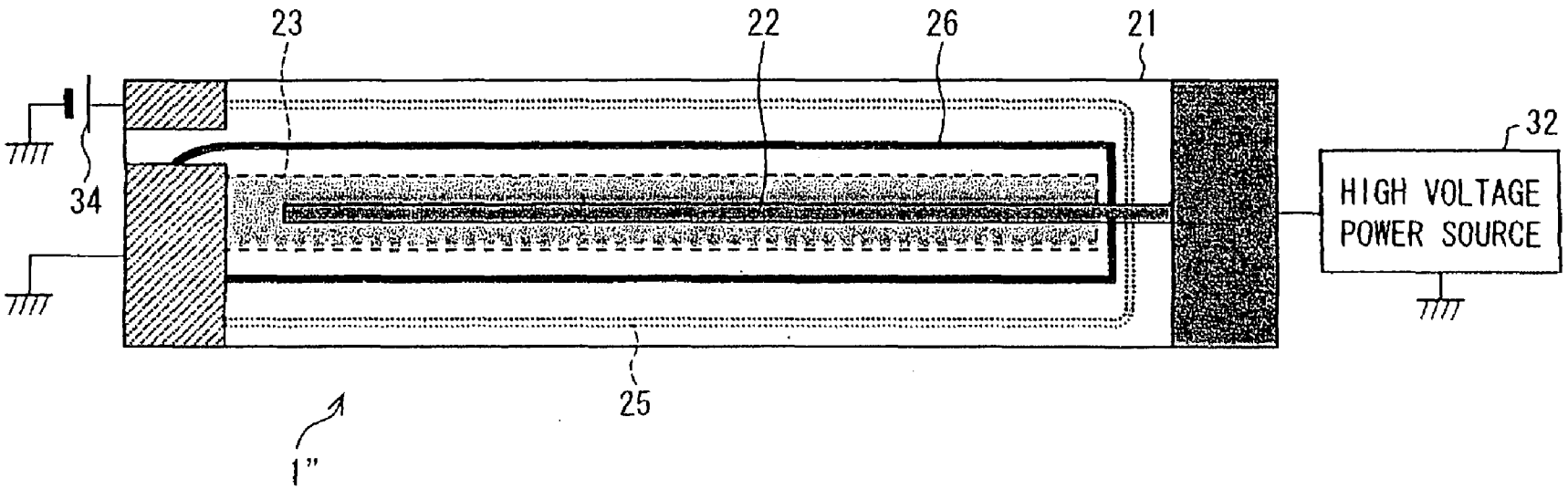
FIG. 6

The inductive electrode 23 is formed inside the dielectric body 21 (between the upper dielectric body 21*a* and the lower dielectric body 21*b*) and is provided so as to be opposed to the discharge electrode 22. This is because it is preferable that the insulation resistance between the discharge electrode 22 and the inductive electrode 23 is uniform and the discharge electrode 22 and the inductive electrode 23 are provided parallel to each other. This arrangement makes it possible to have a constant distance between the discharge electrode 22 and the inductive electrode 23 (hereinafter referred to as a distance between electrodes). Accordingly, a discharge state between the discharge electrode 22 and the inductive electrode 23 becomes stable and ions can be preferably generated. In the arrangement of FIGS. 1(*a*) and 1(*b*), the inductive electrode 23 is made of two line-shaped electrodes provided so as to face each other and be parallel to the discharge electrode 22 in a longitudinal direction such that the discharge electrode 22 is positioned between the line-shaped electrodes, which discharge electrode 22 and the inductive electrode 23 are provided so as to face each other and sandwich the upper dielectric body 21*a*. One of ends of each of the two inductive electrodes 23 is connected with a ground potential (ground) via a ground connecting section (connection for ground) 27. The inductive electrode 23 is not limited to the aforementioned shape, and may be a plane-shaped electrode provided so as to face the discharge electrode 22, as illustrated in FIG. 6.

Note that there is no problem in providing the dielectric body 21 as one layer and the inductive electrode 23 on a back surface of the dielectric body 21. However, this case requires ensuring of a sufficient creeping distance with respect to an applied voltage, or coating the discharge electrode 22 and the inductive electrode 23 with insulation coating layers (protective layers), for preventing the discharge electrode 22 and the inductive electrode 23 from occurrence of the leak via the surface of the dielectric body 21.

As with the discharge electrode 22, a material of the inductive electrode 23 is not specifically limited as long as the material is electrically conductive, for example, tungsten, silver, or stainless steel. The present embodiment employs tungsten or stainless steel as the material of the inductive electrode 23.

The heater electrode 25 is provided inside the dielectric body 21 (between the upper dielectric body 21*a* and the lower dielectric body 21*b*) separately from the inductive electrode 23, and has a line shape. The heater electrode 25 is provided so as to extend along a longitudinal direction of the dielectric body 21, which has an S-shaped bend so as to double back and again extend along the longitudinal direction of the dielectric body 21 parallel to the heater electrode 25 thus extended. The heater electrode is shaped as such so as to raise a resistance to a predetermined value. The heater electrode 25 is not necessarily arranged as the S-shape as long as conditions (modification of material, control in thickness, and the like) which allow achievement of a desired resistance value is satisfied in one simple pattern. An advantage in forming this S-shape is that this shape allows avoiding disconnection which occurs with a thin line pattern (at the time of printing, baking, and use). The heater electrode 25 is provided at a position in which a distance between the discharge electrode 22 and the heater electrode 23 is larger than that between the discharge electrode 22 and the heater electrode 23.

One end of the heater electrode 25 is provided to connect to a heater power source 34, and the other end is provided to connect with a ground potential. The heater power-source 34 applies a predetermined voltage (12 V in the present embodiment) to the heater electrode 25 so that the heater electrode 25 generates Joule heat. By causing the heater electrode 25 to generate the Joule heat, a temperature of the dielectric body 21 rises (to approximately 60° C. in the present embodiment). This suppresses moisture absorption of the dielectric body 21 and allows stable generation of ions in a high humidity environment. In a case where the dielectric body 21 is made of ceramic, moisture is not directly absorbed by the dielectric body 21. However, when dew is condensed on a surface of the dielectric body 21, discharge characteristics deteriorate. Therefore, it is advantageous to prevent or eliminate condensation of dew, by causing the heater to generate heat. The heater electrode 25 and the inductive electrode 23 are provided on an upper surface of the lower dielectric body 21*b* so as to sandwich the shield electrode 26.

The shield electrode 26 is provided on the upper surface of the lower dielectric body 21*b* between the heater electrode 25 and the inductive electrode 23, and has the ground connecting section 27 so as to connect with a ground potential. The shield electrode 26 is provided for preventing a leak to the heater electrode 25. In view of ensuring a shielding function, it is preferable for the shield electrode 26 to have a wider width with respect to a width of the inductive electrode 23.

It is required for the shield electrode 26 to be provided at least so that most of the discharge occurs between the inductive electrode 23 and the discharge electrode 22. This position may be determined in consideration of aspects such as (i) actual use performance such as a required amount of discharge current, uniformity, an amount of ozone generated, and a target life, and (ii) balance with cost. In order to determine the position, the shield electrode 26 may be arranged for instance so that a distance between the shield electrode 26 and the inductive electrode 23 is provided larger than that between the discharge electrode 22 and the inductive electrode 23 (at least twice a larger distance, and an electric field strength of equal to or less than half). This is simply an example, and the arrangement is not limited to this arrangement as long as the shield electrode 26 is provided so that most of the discharge occurs between the inductive electrode 23 and the discharge electrode 22. Note that the distance between the discharge electrode 22 and the inductive electrode 23 is represented by: $((\text{projection distance})^2+(\text{stacking direction distance})^2)^{0.5}$, where "projection distance" denotes a distance between the discharge electrode 22 and the inductive electrode 23 in longitudinal and transverse directions as illustrated in FIG. 1(*a*), and "stacking direction distance" denotes a thickness of the upper dielectric body 21. However, the stacking direction distance is approximately several ten μm to 200 μm. If the projection distance is in millimeter-order, the distance between the discharge electrode 22 and the inductive electrode 23 may be considered to be substantially same as the projection distance.

In the ion generating element 1 of the present embodiment, the heater electrode 25 and the inductive electrode 23 are provided independently on a same surface of the upper dielectric body 21*a* (an upper surface of the lower dielectric body 21*b*). The inductive electrode 23 and the heater electrode 25 are positioned in such a manner that the heater current does not flow in the inductive electrode 23. Due to this arrangement, a resistance value of the inductive electrode 23 does not affect the heater electrode 25. Thus, it is possible to appropriately set an appropriate size or shape of the inductive electrode 23, according to various conditions. Further, without any influence on discharge characteristics between the discharge electrode 22 and the inductive electrode 23, the heater electrode 25 can heat the ion generating element 1 so as to decrease absorption moisture. Therefore, the ion generating element 1 can discharge stably and effectively. Furthermore, in a case where the heater electrode 25 uses a voltage (e.g. 12 V and 24 V) that is also used for discharge for generating ions, it is possible to adjust a width and a length of the heater electrode 25 so that the ion generating element 1 receives a desired input power supply for the heating.

It is preferable that the discharge electrode 22 and the inductive electrode 23 are plated with copper, gold, nickel or the like. The plating extends life duration as the electrodes and also increases strength of the electrodes.

The coating layer 24 is formed on the dielectric body 21 so as to cover the discharge electrode 22, by using, for example, alumina (aluminum oxide), glass, silicon, or the like. In a case where the discharge electrode 22 is made of material that is strong against oxidation and abrasion caused by electrical effects, the coating layer 24 is not necessarily provided.

A fabrication method of the ion generating element 1 is explained here. However, the fabrication method is not limited to the following method or numeral values. First, an alumina sheet having a thickness of 0.2 mm is cut to a predetermined size (for example, 8.5 mm in width×320 mm in length) and two alumina bases that have substantially the same size are formed. These alumina bases are used as the upper dielectric body 21*a* and the lower dielectric body 21*b*. Next, on an upper surface of the upper dielectric body 21*a*, tungsten is screen-printed in a comb-tooth shape as the discharge electrode 22 so that the discharge electrode 22 is integrally formed with the upper dielectric body 21*a*. On the other hand, as the heater electrode 25, the shield electrode 26 and the inductive electrode 23, tungsten is screen-printed on an upper surface of the lower dielectric body 21*b* so that the heater electrode 25, the shield electrode 26 and the inductive electrode 23 are formed to be integral with the lower dielectric body 21*b*. In the present embodiment, the inductive electrode 23 includes two inductive electrodes printed parallel to the dielectric body 21 in a longitudinal direction, so as to sandwich the discharge electrode 22. The heater electrode 25 is printed at a position in which a distance between the discharge electrode 22 and the heater electrode 25 is larger than that between the discharge electrode 22 and the inductive electrode 23. Moreover, the shield electrode 26 is printed so as to be provided between the heater electrode 25 and the inductive electrode 23. Note that, also in order to ensure a shielding function, it is preferable for the shield electrode 26 to be provided having a wider width than that of the inductive electrode 23.

Further, the coating layer 24 made of alumina is formed on a surface of the upper dielectric body 21*a* so as to cover the discharge electrode 22. This forms insulation coating of the discharge electrode 22. After a lower surface of the upper dielectric body 21*a* and an upper surface of the lower dielectric body 21*b* are brought together so that the discharge electrode 22 is sandwiched between the two inductive electrodes of the inductive electrode 23 via the upper dielectric body 21*a*, crimping is carried out. Then, the upper dielectric body 21*a* and the lower dielectric body 21*b* are put into a furnace and baked in non-oxidizing atmosphere at a temperature in a range of 1400° C. to 1600° C. The ion generating element 1 of the present embodiment can be easily fabricated in this way. Crimping of unbaked sheets may be performed before printing the discharge electrode 22 or before/after formation of the coating layer 24. Moreover, the number of crimping may be determined as appropriate.

The counter electrode 31 of the present embodiment is a stainless steel plate. The counter electrode 31 is provided in a position that is opposed to the ion generating element 1 via the intermediate transfer belt 15 so that the counter electrode 31 touches a back surface (surface on a side where a toner image is not formed) of the intermediate transfer belt 15. The counter electrode 31 is connected to ground via the counter electrode power source 35. The counter electrode power source 35 is arranged to apply a predetermined voltage to the counter electrode 31. This counter electrode power source 35 is provided to allow discharge from the discharge electrode 22 to occur more easily. The counter electrode power source 35 is not necessarily required, but is dispensable.

The high voltage power source (a voltage application circuit) 32 is arranged to apply a high alternating voltage between the discharge electrode 22 and inductive electrode 23 of the ion generating element 1, under control of a voltage controlling circuit 33. The high voltage power source 32 employs a pulse wave of an applied voltage Vpp in a range of 2 kV to 4 kV, an offset bias in a range of −1 kV to −2 kV, and a frequency f in a range of 500 Hz to 2 kHz. A high-voltage-side-time duty of the pulse wave is arranged to be in a range of 10% to 50%. A waveform of the applied voltage may be a sine wave. However, a pulse wave is more preferable, in consideration of discharge efficiency and particularly discharge performance under a high humidity condition.

When an alternating high voltage is applied between the discharge electrode 22 and the inductive electrode 23 by operating the high voltage power source 32 with the above arrangement, creeping discharge (corona discharge) occurs in the vicinity of the discharge electrode 22 due to an electric potential difference between the discharge electrode 22 and the inductive electrode 23. This ionizes an atmosphere surrounding the discharge electrode 22 and generates negative ions. Consequently, a toner image on the intermediate transfer belt 15 is charged to a predetermined charging amount (here approximately −30 μC/g).

Further, the high voltage power source 32 is connected to the voltage controlling circuit 33. The voltage controlling circuit 33 controls an applied voltage level of the high voltage power source 32. Specifically, the voltage controlling circuit 33 measures a value of a current flowing in the counter electrode power source 35, and performs a feedback-control of a voltage applied by the high voltage power source 32 so that the measured value of the current is set to be a target value.

A value of a current that flows in the counter electrode 31 correlates with a charged amount of the toner image. Therefore, when the current that flows in the counter electrode 31 is kept constantly at a target value, the charged amount of the toner image is kept at a constant value.

Thus, according to amperes of the current flowing in the counter electrode 31, volts of the applied voltage of high power source 32 is feedback-controlled. Consequently, an appropriate amount of ions is supplied to the toner image all the time, even when a generation amount of ions or a ratio of the generated ions reaching the toner image varies according to (i) adherence of foreign matters to a tip of the discharge electrode 22, (ii) a change in surrounding conditions, (iii) a change of a wind in the image forming apparatus 100, and the like.

As described above, in the ion generating element 1 of the present embodiment included in the charging device (the first pre-transfer charging device 2, the second pre-transfer charging device 3 and the latent image charging device 4) of the present embodiment, the heater electrode 25 for warming the ion generating element 1 by Joule heat produced because of a passage of an electrical current is provided on a surface of the upper dielectric body 21*a* at a side on which the inductive electrode 23 is provided, in such a manner that the distance between the discharge electrode 22 and the heater electrode 25 is larger than the distance between the discharge electrode 22 and the inductive electrode 23. Moreover, the shield electrode 26 which has the ground connecting section 27 is provided between the heater electrode 25 and the inductive electrode 23 on a surface of the upper dielectric body 21*a* at the side on which the inductive electrode 23 is provided.

According to the arrangement, when a breakage in the ion generating element 1 occurs, which causes a leak path to generate, although the leak path to the inductive electrode 23 is blocked, the shield electrode 26 is subsequently subject to a leak. The shield electrode 26 is connected with a ground potential via a ground connecting section, which causes a leak current to flow to ground. Thus, it is possible to prevent the leak to the heater electrode 25. Since the leak to the heater electrode 25 is prevented, damage to the heater power source 34 would not occur; breakage of a machine including the ion generating element 1 and occurrence of an ignition accident are also prevented. Thus, it is possible to provide an ion generating element which gives consideration towards safety.

Moreover, the inductive electrode 23 and the heater electrode 25 are provided on a same surface of the upper dielectric body 21*a* (or can also be an upper surface of the lower dielectric body 21*b*), and the shield electrode 26 is provided between the inductive electrode 23 and the heater electrode 25. Thus, an insulation distance is easily provided in a plane direction of the dielectric body 21. Therefore, use of a thick dielectric body is not required in order to provide a distance between the discharge electrode 22 and the heater electrode 25. Furthermore, an electrode layer is made of two layers (the discharge electrode 22, and the inductive electrode 23, the heater electrode 25 and the shield electrode 26), arranged such that the upper dielectric body 21*a* is sandwiched between the two layers. Hence, the arrangement is simple, which allows easy arrangement at low cost.

Figure 8:
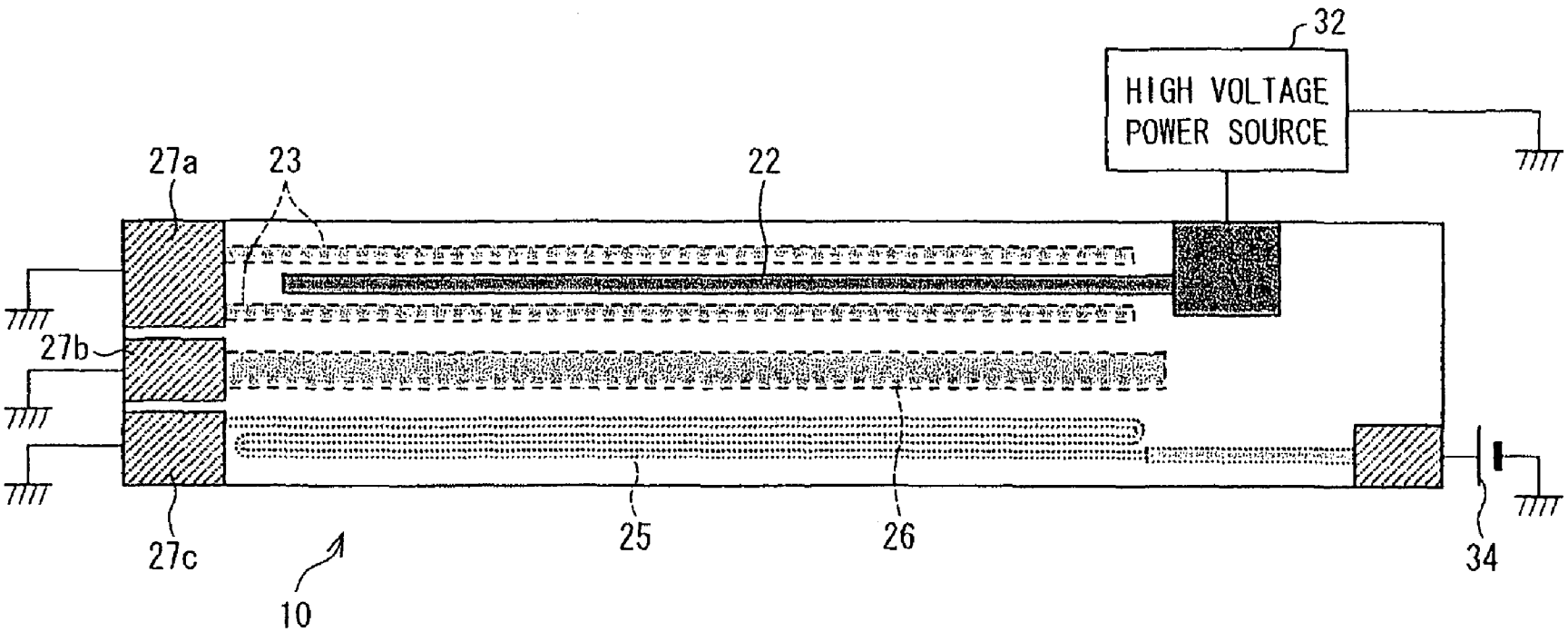
FIG. 8

In the present embodiment, one ends of each of the shield electrode 26, the inductive electrode 23, and the heater electrode 25 are arranged as a common ground electrode (ground connecting section 27). A same operation as the present embodiment is attained even in a case where the shield electrode 26, the inductive electrode 23, and the heater electrode 25 have independent potentials or electrodes. FIG. 8 illustrates an example in which independent ground electrodes are provided for each of the shield electrode 26, the inductive electrode 23, and the heater electrode 25. In the ion generating element illustrated in FIG. 8, a ground connecting section 27*a* is provided for the inductive electrode 23, a ground connecting section 27*b* is provided for the shield electrode 26, and a ground connecting section 27*c* is provided for the heater electrode 25.

Figure 10:
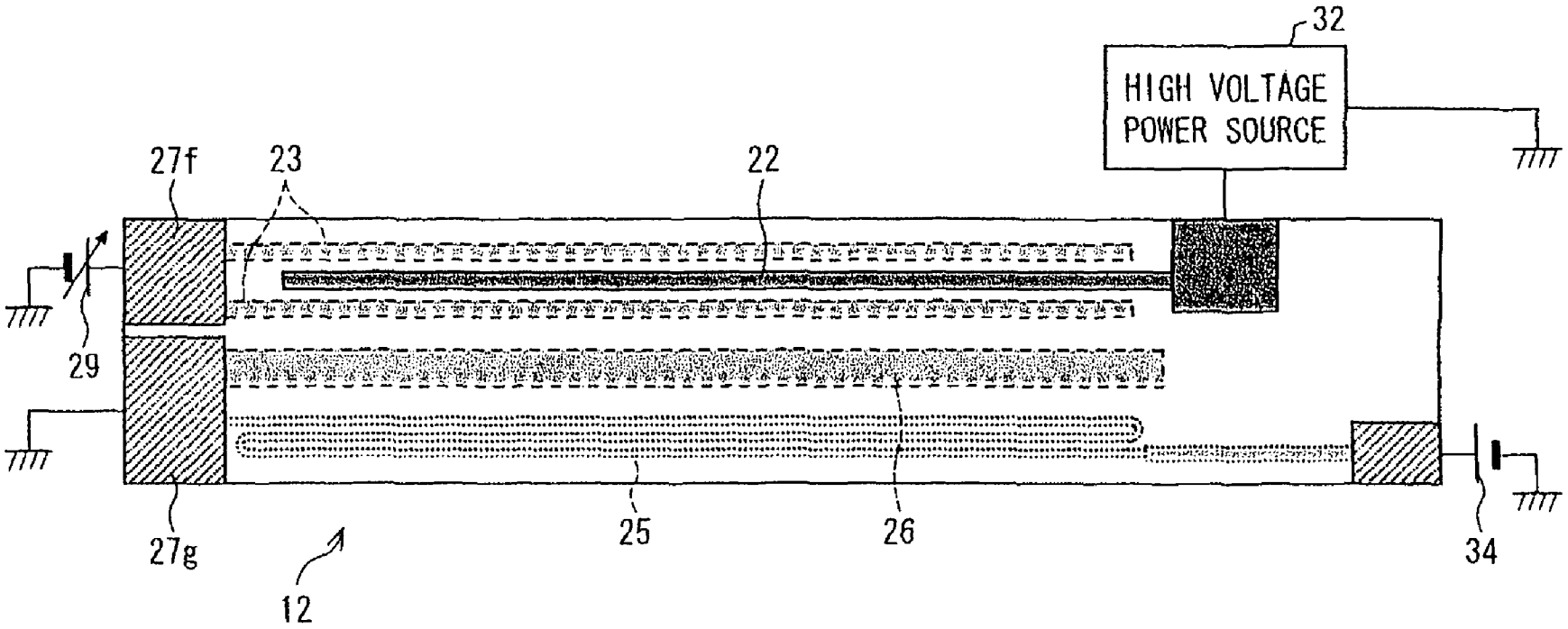
FIG. 10 is a front elevational view illustrating still another example of an ion generating element according to the technology disclosed herein.

For example, in a case where an arbitrary bias is applied to the inductive electrode 23 so as to control an amount of ion supplied as illustrated in FIG. 10, a potential of the shield electrode 26 may be grounded independently, or may be grounded together with one end of the heater electrode 25. FIG. 10 illustrates an arrangement including a power source 29 for controlling an amount of ion to be supplied, since an arbitrary bias is applied to the inductive electrode 23. An ion generating element 12 illustrated in FIG. 10 includes a ground connecting section 27*f* of the inductive electrode 23 and a ground connecting section 27*g* common to the shield electrode 26 and the heater electrode 25. When a breakage occurs to the ion generating element 1 in such an arrangement, a leak occurs to the inductive electrode 23 from a high voltage line. However, since a high voltage power source that is capable of applying several 100 V of voltage is used as the power source 29 for controlling the amount of ion supplied, resistance of the power source 29 against the leak from the high voltage line is relatively high. Thus, the possibility is low for the power source of the inductive electrode 23 to receive great damage. Moreover, in view of a whole image forming apparatus, the power source 29 is different from a power source related to an operation with respect to the whole machine, such as the 5 V type and 12 V type. Therefore, there is a low possibility that the damage is given to the whole of the machine. Moreover, the shield electrode 26 itself is connected with a ground potential. Therefore, it is possible to prevent the damage caused at the time of the leak via the heater electrode 25, to the heater power source 34 or the whole machine. Furthermore, this arrangement is suitable due to its simple arrangement of the element, by having the shield electrode and one end of the heater line as a common ground potential contact point.

Figure 9:
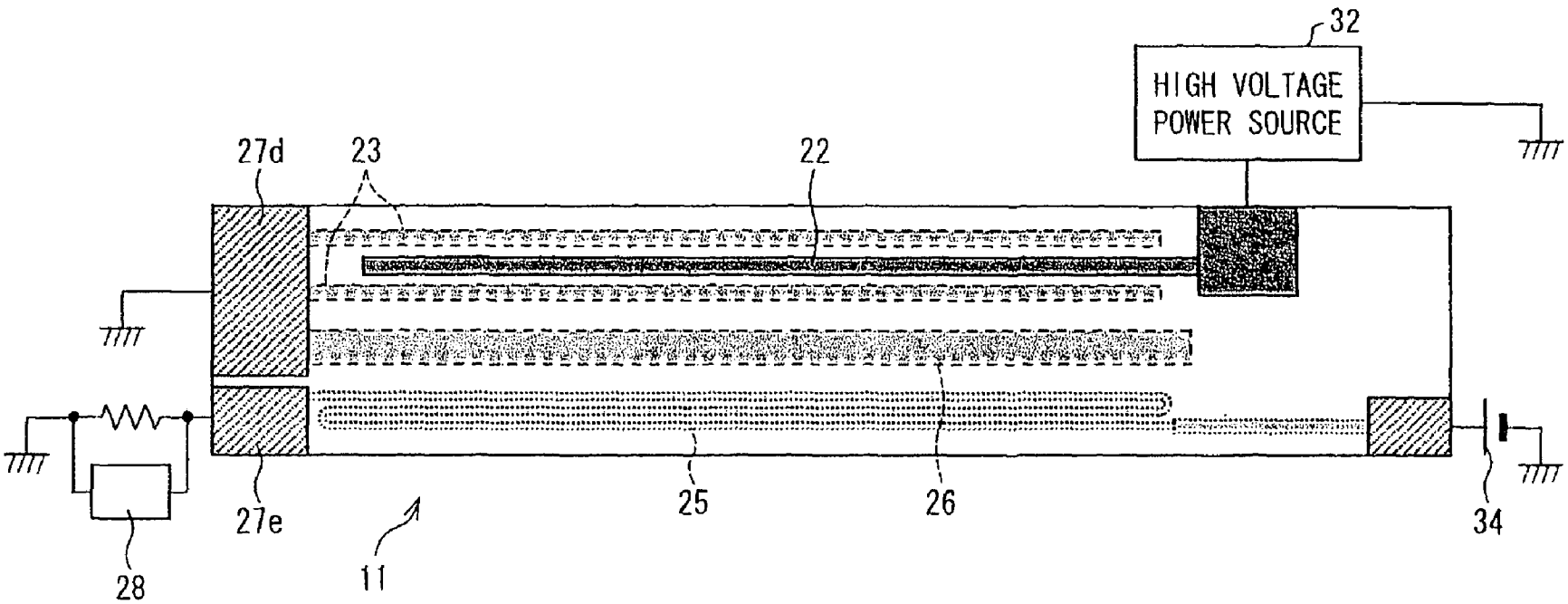
FIG. 9

Alternatively, as another arrangement example, a ground potential common to the inductive electrode 23 and the shield electrode 26 may be provided, as illustrated in FIG. 9. This arrangement is applicable, for example, in a case where an end of the heater electrode 25 opposite to an end connected to the heater power source 34 is not directly grounded but is connected to a resistance for detecting heater operation, or in a case of an electrode pattern in which a ground electrode of the heater electrode 25 is not provided in the vicinity of a connection for ground (ground terminal part) of the shield electrode 26. For example, when it is necessary to provide a heater operation detection section 28 for detecting an operation of the heater electrode 25, adoption of the arrangement as illustrated in FIG. 9 is desirable due to its simple and functional arrangement of an element. In the ion generating element 11 in FIG. 9, a ground connecting section 27*d* common to the inductive electrode 23 and the shield electrode 26, and a ground connecting section 27*e* of the heater electrode 25 are provided.

As described above, standardization of the ground connecting section of the shield electrode 26 is selectable as appropriate from related peripheral conditions. However, the ground connecting section 27 common for all the electrodes as in the embodiment is advantageous for (i) preventing generation of a defective element by simplification of a pattern, (ii) easiness in connection wiring of an element and a ground potential, (iii) ensuring of further safety at a time of a leak, and the like.

EXAMPLE 1

The following description explains an Example which uses an ion generating element of the technology disclosed herein. Here, ion generating elements of Examples and Comparative Examples are explained with reference to FIGS. 1, 4, and 7.

Figure 7:
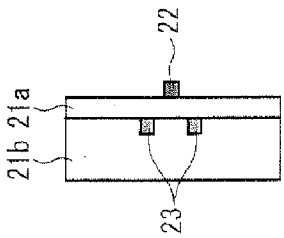
PRIOR ART FIG. 7 (c)
FIG. 7
Figure 7:
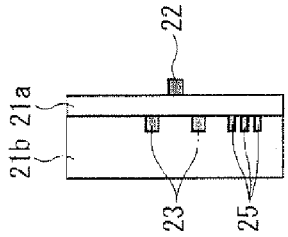
PRIOR ART FIG. 7 (d)
Figure 7:
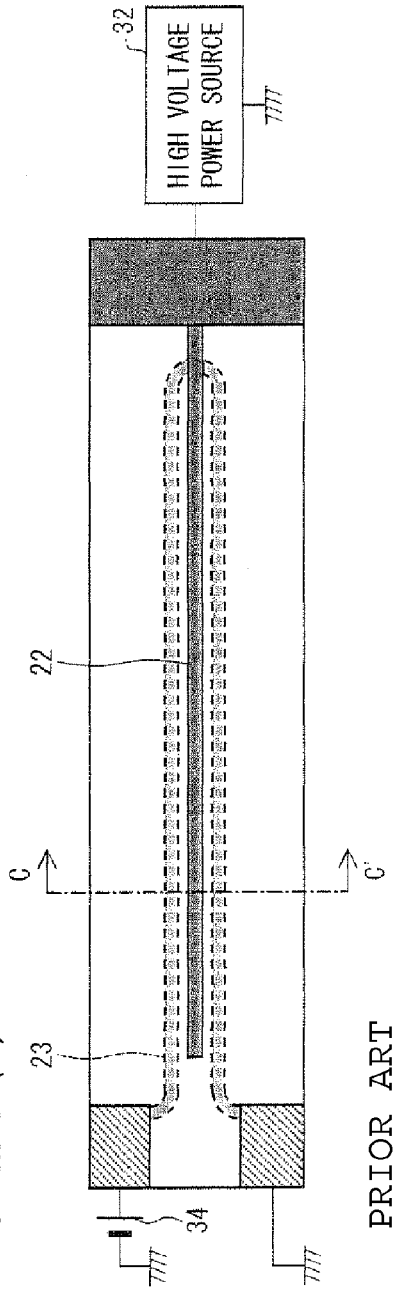
PRIOR ART FIG. 7 (a)
Figure 7:
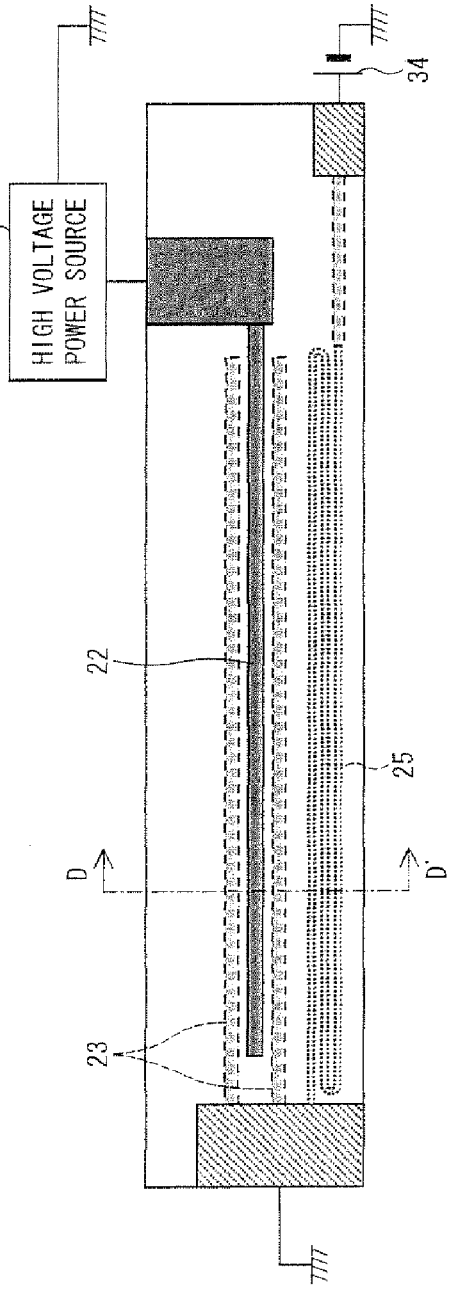
PRIOR ART FIG. 7 (b)

FIGS. 7(*a*) and 7(*b*) illustrate an ion generating element of a comparative example. In the ion generating element of Comparative Example 1 illustrated in FIG. 7(*a*), the inductive electrode 23 was line-shaped, and was bent in a U-shape so as to surround the discharge electrode 22. A bias voltage was applied to both ends of the inductive electrode 23 so that the inductive electrode 23 functioned as a heater. Namely, in Comparative Example 1, the inductive electrode 23 doubled as a heater electrode. In this Comparative Example 1, a width of the inductive electrode 23 was approximately 0.2 mm, a length thereof was approximately 600 (300×2) mm, and a resistance value thereof was approximately 30 Ω.

An ion generating element in Comparative Example 2 as illustrated in FIG. 7(*b*) was arranged in such a manner that the inductive electrode 23 and the heater electrode 25 were independently provided. Two line-shaped electrodes having a width of 0.2 mm were provided on both sides of the discharge electrode 22, parallel to the discharge electrode 22 in a longitudinal direction, so as to sandwich the discharge electrode 22 therebetween. This two line-shaped electrodes served as the inductive electrode 23.

The heater electrode 25 was provided in an S-shape, and extending in a longitudinal direction of the dielectric body 21.

A bias voltage was applied to both ends of the heater electrode 25 so that the heater electrode 25 functioned as a heater. A width of the heater electrode was 0.2 mm, a length thereof was approximately 900 (300×3) mm, and a resistance thereof was 30 Ω.

On the other hand, the ion generating element 1 of Example (Example 1) according to the technology disclosed herein had the shield electrode 26 provided between the inductive electrode 23 and the heater electrode 25, as illustrated in FIG. 1. However, the discharge electrode 22, as with the ion generating element of Comparative Example 2, was line-shaped. That is to say, although the ion generating element 1 of the present Example 1 had the discharge electrode 22 and the inductive electrode 23 positioned slightly shifted to an edge of the dielectric body 21 as compared to the ion generating element of Comparative Example 2illustrated in FIG. 7(*b*), the discharge electrode 22, the inductive electrode 23, and the heater electrode 25 were arranged as with the aforementioned Comparative Example 2. Although consideration is required in design so that an object to be charged is relatively positioned due to the positioning of the discharge electrode 22 and the inductive electrode 23 slightly shifted to the edge of the dielectric body 21, the object to be charged is sufficiently positioned as long as the object to be charged can be given electric charge appropriately, as illustrated in FIG. 3(*a*).

A width of the shield electrode 26 is approximately 1 mm, and the shield electrode 26 is arranged in a substantially intermediate position between the inductive electrode 23 and the heater electrode 25. A positioning of the shield electrode 26 too close to the inductive electrode 23 causes the shield electrode 26 to operate as an inductive electrode. This may result in a change in discharge property. Therefore, it is desirable for a distance between the shield electrode 26 and the inductive electrode to be at least larger than a distance between the discharge electrode 22 and the inductive electrode 23. In the present Example, the distance between the shield electrode 26 and the inductive electrode 23 was 0.7 mm, and the distance between the discharge electrode 22 and the inductive electrode 23 was 0.1 mm.

In the present Example, the shield electrode 26 had a connection for ground on one end for grounding the shield electrode 26. Further, this connection for ground, the connection for ground of the inductive electrode 23, and the connection for ground on one end of the heater electrode 25 had a common wiring pattern. Therefore, connection with the ground potential were carried out with a simple arrangement, which as a result allows formation of a highly reliable connection for ground at low cost.

It is desirable for the heating performance of the ion generating element to be one which heats the ion generating element 20° C. to 30° C. higher than room temperature. This is because if the ion generating element is excessively heated, an adverse effect may be given in discharge property due to fusing of toner or safety. In the present Example and Comparative Examples 1 and 2, 12 V was applied to a heater line, and the element was heated by making electricity of around 5 W. In the present Example and Comparative Examples 1 and 2, the upper dielectric body 21*a* provided between the discharge electrode 22 and the inductive electrode 23 was made of ceramic having a thickness of 0.2 mm, and the lower dielectric body 21*b* was made of ceramic having a thickness of 0.7 mm so as to protect and improve strength of the inductive electrode 23 and the heater electrode 25. As such, the dielectric body had a total thickness of approximately 0.9 mm. Ceramics is used for the dielectric body 21 due to its (i) few material property change for a long term, (ii) stableness in insulation property, and (iii) maintainability of a constant discharge property. The thickness may be made thicker, however disadvantages arise such that (i) costs increase, (ii) a large amount of electricity is required to heat the ion generating element by the heater, and (iii) the heating time becomes long which causes usability to decrease.

Figure 4:
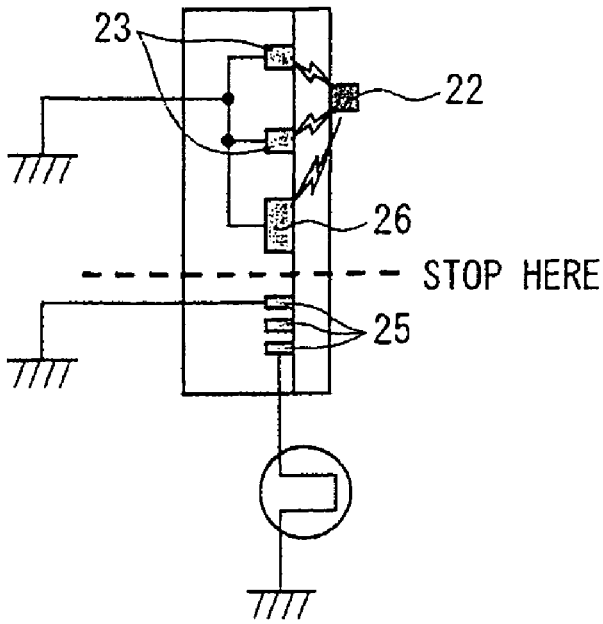
FIG. 4
Figure 4:
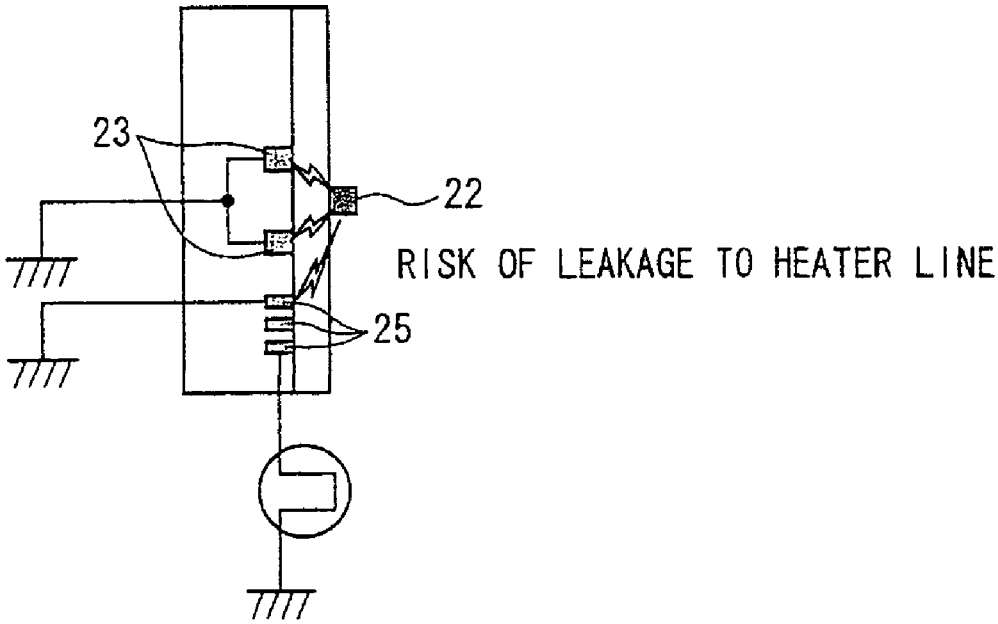

The following description explains operations of the present Example with reference to FIGS. 4(*a*) and 4(*b*). FIG. 4(*a*) is a cross sectional view of an ion generating element, and FIG. 4(*b*) is a cross sectional view of an ion generating element of Comparative Example 2. The two views explain a situation when a leak occurs from the discharge electrode 22 at a time when the element breaks due to an unexpected accident or the like.

First, in a case of the ion generating element of Comparative Example 2, when the ion generating element breaks, a leak to the inductive electrode 23 which is closest to the discharge electrode 22 first occurs, as illustrated in FIG. 4(*b*). Meanwhile, as also illustrated in FIG. 4(*b*), a leak may also occur to the heater electrode 25, depending on (i) the applied voltage to the discharge electrode, (ii) the distance between the discharge electrode 22 and the heater electrode 25, and (iii) the state of the broken surface. Moreover, in a case where the upper dielectric body 21*a* is made of resin, occurrence of the leak while discharge is carried out causes the resin to melt. This melted resin blocks a leak path to the inductive electrode 23. Suppression of generation of ozone or the like is attained by forming the inductive electrode 23 in a line-shape, such that a discharge region width is made narrow. However, if a line width is narrow, there is a high possibility that the leak path becomes blocked. As a result, the leak from the discharge electrode 22 flows to the heater electrode 25. This may cause damage to the heater power source 34, and at the worst, may lead to a breakdown of a whole machine including the ion generating element or an occurrence of an ignition accident.

In the case of the ion generating element of Comparative Example 1, the inductive electrode 23 doubles as the heater. Therefore, breakage of the element may cause breakage of the heater power source 34 due to the occurrence of the leak from the discharge electrode 22 to the inductive electrode 23, or may lead to the breakage of the whole machine including the ion generating element or an occurrence of an ignition accident.

In the case of the ion generating element 1 of the present Example, when the element breaks, a leak to the shield electrode 26 occurs as a subsequent step to the occurrence of the leak to the inductive electrode 23, as illustrated in FIG. 4(*a*). A potential difference between the shield electrode 26 and the heater electrode 25 is around several 10 V at most, and a distance between the electrodes also is in millimeter order. Thus, an electric field strength between the two electrodes is extremely small. Hence, leak from the shield electrode 26 to the heater electrode 25 does not occur.

EXAMPLE 2

Figure 5:
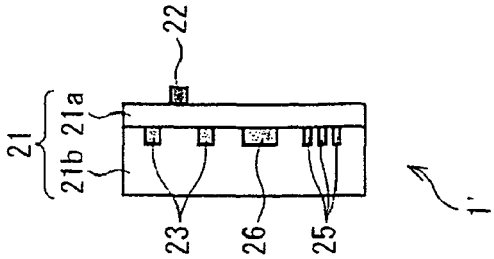
FIG. 5
Figure 5:
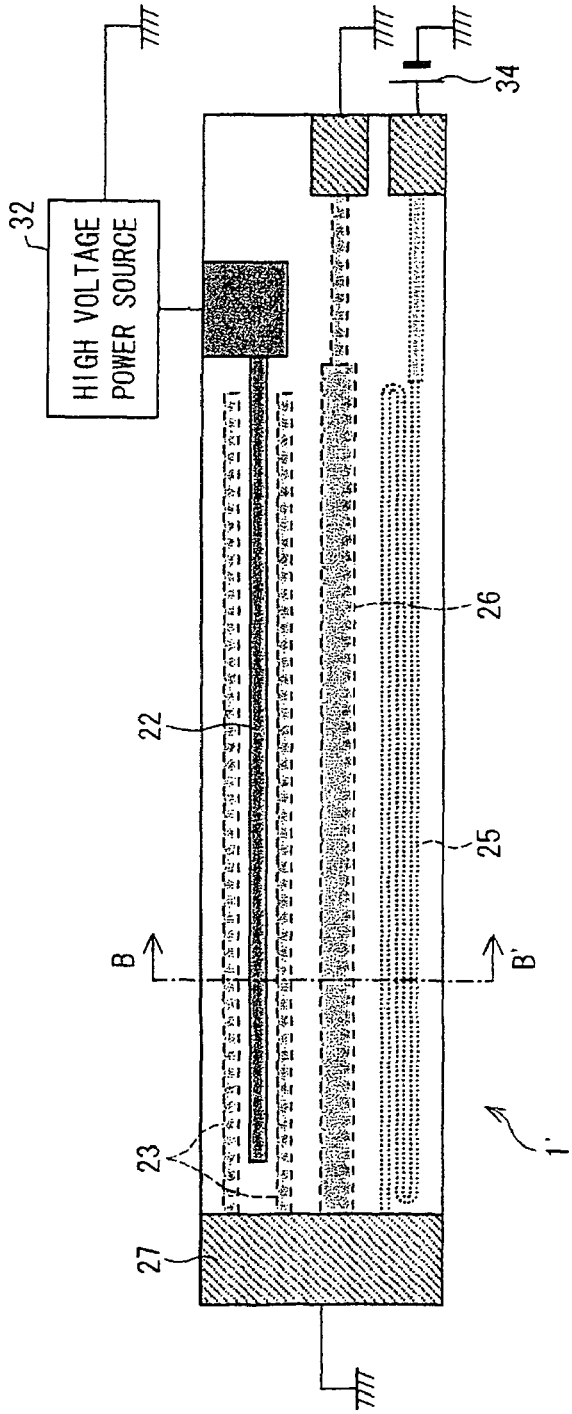

The following description explains another Example of an ion generating element according to the technology disclosed herein. As illustrated in FIG. 5, an ion generating element 1' of the present Example (Example 2) included, in addition to the arrangement of the ion generating element 1, a shield electrode 26 in which both ends of the shield electrode 26 in a longitudinal direction each have a connection of ground. Each connection of ground was arranged to be connected with a ground potential. When the ion generating element 1 breaks, although an end section provided with the connection of ground of the shield electrode 26 (side with which the ground potential is connected) maintains a ground potential, an end section of the other side becomes in a floating state. In this case, the part that becomes in the floating state serves simply as a bridge electrode to a heater line. This gives a concern that the shield electrode 26 cannot function to shield the leak current. However, adoption of an arrangement in which both sides of the shield electrode 26 in the longitudinal direction each have the connection for ground as with the ion generation element 1' of the present Example allows maintaining of the ground potential at both sides of a broken part of the ion generation element 1, which makes it possible to attain a stable shield electrode operation. Thus, such arrangement is more preferable.

EXAMPLE 3

The following description explains still another Example of an ion generating device according to the technology disclosed herein. The ion generation element 1", as illustrated in FIG. 6, has a heater electrode 25 formed in a U-shape so as to surround a plane-shaped inductive electrode 23. Further, a shield electrode 26 is provided in a U-shape between the heater electrode 25 and the inductive electrode 23. In this case also, both ends of the shield electrode 26 each had a connection for ground, and each connection for ground was connected with a ground potential. Even in such an arrangement, it is possible to effectively prevent occurrence of the leak.

As described above, an ion generating element according to the technology disclosed herein generates ions in conjunction with creeping discharge by applying a voltage so that a potential difference is given between a discharge electrode and an inductive electrode, the discharge electrode and the inductive electrode being provided so as to sandwich a dielectric body therebetween, the ion generating element including: a heater electrode for warming the ion generating element by Joule heat produced because of a passage of an electrical current, the heater electrode being provided, on the surface of the dielectric body at a side on which the inductive electrode is provided, so that a distance between the discharge electrode and the heater electrode is larger than that between the discharge electrode and the inductive electrode; and a shield electrode, having a connection for ground, and provided between the heater electrode and the inductive electrode on a surface of the dielectric body on which the inductive electrode is provided.

The ion generating element according to the technology disclosed herein, in addition to the above arrangement, may be arranged such that the inductive electrode is connected with a connection for ground of the shield electrode.

In a case where a power source for applying bias voltage is connected to the inductive electrode, when the element breaks by which a leak to the inductive electrode occurs, the power source may break due to the leak to a bias power source. Adoption of the arrangement according to the technology disclosed herein enables leak current to flow to ground. Thus, no such breakage of the power source occurs. Further, the inductive electrode and the shield electrode are connected with a ground potential via a common electrode pattern. This allows simplification of (i) a wiring pattern of the element and (ii) an arrangement for connecting with the ground potential. Hence, this arrangement can attribute to the improvement in reliability and reduction in cost of the apparatus. Note that a connection for ground of the inductive electrode and a connection for ground of the shield electrode may be connected together, or may be provided as a common connection for ground.

The ion generating element of the technology disclosed herein, in addition to the above arrangement, may be arranged such that the heater electrode has one end to be connected to a heater power source, and the other end to be connected with a connection for ground other than the connection for ground of the shield electrode.

According to the arrangement, one end of the heater electrode is connected to a heater power source, and the other end is connected with a connection for ground other than the connection for ground of the shield electrode. Here, the inductive electrode is connected with the connection for ground of the shield electrode. As such, the inductive electrode and the heater electrode are not electrically connected to each other. This prevents flowing of a discharge current in the heater power source via the heater electrode, which flowing of a discharge current causes damage to the whole machine.

The ion generating element according to the present invention, in addition to the above arrangement, may be arranged such that the heater electrode has one end to be connected to a heater power source, and the other end to be connected with the connection for ground of the shield electrode.

According to the arrangement, one end of the heater electrode and one end of the shield electrode are connected with a ground potential via a common electrode pattern. This allows simplification of (i) the wiring pattern of the element and (ii) the arrangement for connecting with the ground potential. Hence, this arrangement can attribute to the improvement in reliability and reduction in cost of the apparatus. Note that the connection for ground of the heater electrode and the connection for ground of the shield electrode may be connected together, or may be provided as a common connection for ground.

The ion generating element according to the present invention, in addition to the above arrangement, may be arranged such that the inductive electrode is connected with a connection for ground other than the connection for ground of the shield electrode.

Here, when the inductive electrode is disconnected (e.g. not grounded, or not connected with a desired potential supplying section), discharge current may flow in the heater power source via the heater electrode, which causes damage to a whole machine. However, according to the arrangement, the inductive electrode and the heater electrode are not electrically connected to each other. Thus, it is possible to prevent the discharge current to flow in the heater electrode, which flow of the discharge current causes damage to the whole machine.

The ion generating element according to the present invention, in addition to the above arrangement, may be arranged such that the shield electrode is line-shaped, and its both ends in a longitudinal direction each have a connection of ground.

In a case where the ion generating element breaks orthogonally with respect to a longitudinal direction of the shield electrode, although a side of the shield electrode which has the connection for ground maintains its ground potential, a side which is not grounded becomes in a floating state. In this case, a part in the floating state may act as a bridge electrode to a heater line. As a result, the shield electrode may not be able to attain the function so as to shield the leak current. Accordingly, as in the arrangement, adoption of an arrangement in which both sides of the shield electrode in the longitudinal direction each have the connection for ground allows maintaining of the ground potential at both sides of a broken shield electrode. This allows stable attainment of the shield electrode operation, and therefore is more preferable.

It is preferable for the ion generating element of the present invention to be arranged such that a distance between the shield electrode and the inductive electrode is larger than that between the discharge electrode and the inductive electrode.

A positioning of the shield electrode too close to the inductive electrode causes the operation of the inductive electrode to be carried out by the shield electrode. This may result in a change in discharge property. By thus having the above arrangement, it is possible to arrange the shield electrode so that the operation of the inductive electrode is not mainly carried out by the shield electrode. Note that as long as the shield electrode does not mainly carry out the operation of the inductive electrode, the arrangement is not limited to the above arrangement.

It is preferable for the ion generating element of the present invention to be arranged such that the dielectric body is made of ceramic or glass as its main component.

In the ion generating element (creeping discharge element), it is desirable for an insulation property of the dielectric body provided between the discharge electrode and the inductive electrode to be maintained for a long term. Here, if a dielectric body made of organic material is used, the insulation performance of the dielectric body may decrease due to electrical stress caused by long-term discharge or damage caused by generated ozone. On the other hand, when a dielectric body made of inorganic material such as ceramic or glass is used, such degrading of performance occurs less frequently, and a stable performance is maintained for a long term. Although breakage such as breakage due to unexpected contact and load readily occur with such material, adoption of the arrangement of the present invention which provides the shield electrode allows prevention of a leak to the heater electrode, even if an unexpected breakage occurs. Thus, it is possible to prevent major accidents beforehand. Hence, the ion generating element according to the present invention which has such arrangement can attain both improvement in performance and safety.

In order to attain the object, a charging device according to the present invention includes: any one of the foregoing ion generating elements; and a power source section for applying the voltage between the discharge electrode and the inductive electrode, the voltage being an AC voltage.

According to the arrangement, breakage of a heater power source is prevented since the charging device includes the ion generating element according to the present invention. Hence, a safe and compact charging device is provided.

An image forming apparatus according to the present invention includes: an electrostatic latent image bearing member; and a charging device for charging the electrostatic latent image bearing member; the charging device being the foregoing charging device of the present invention.

Use of the charging device of the present invention as a device for charging an electrostatic latent image prevents breakage of a heater power source of the charging device. This as a result prevents breakage of a whole image forming apparatus. Thus, it is possible to provide a safe image forming apparatus. Furthermore, the charging device of the present invention is compact in size as described above. Hence, it is possible to provide a compact image forming apparatus.

An image forming apparatus according to the present invention includes: a transfer receiving body; an image bearing member for bearing a toner image to be transferred to the transfer receiving body; and a pre-transfer charging device for charging the toner image, the charging device being the foregoing charging device of the present invention.

Use of the charging device according to the present invention as a pre-transfer charging device allows prevention of breakage of a heater power source of the charging device. This prevents breakage of a whole image forming apparatus. Hence, it is possible to provide a safe image forming apparatus. Further, the charging device of the present invention is compact in size, as described above. Consequently, toner, which has not been transferred yet, can be charged in a limited space, which allows reduction in size of the image forming apparatus.

The embodiments and concrete examples of implementation discussed in the foregoing detailed explanation serve solely to illustrate the technical details of the present invention, which should not be narrowly interpreted within the limits of such embodiments and concrete examples, but rather may be applied in many variations within the spirit of the present invention, provided such variations do not exceed the scope of the patent claims set forth below.

Note that the present invention can be used as a charging device of an image forming apparatus employing an electrophotographic process, the charging device for (i) pre-transfer charge for charging a toner image that has not been transferred yet, formed on an image bearing member such as a photoreceptor and an intermediate transfer body, (ii) latent-image charge for charging the photoreceptor, and (iii) auxiliary charge for helping charging toner in a developing device.

The invention claimed is:

1. An ion generating element for generating ions in conjunction with creeping discharge by applying a voltage so that a potential difference is given between a discharge electrode and an inductive electrode, the discharge electrode and the inductive electrode being provided so as to sandwich a dielectric body therebetween, said ion generating element comprising:

a heater electrode for warming the ion generating element by Joule heat produced because of a passage of an electrical current, the heater electrode being provided, on the surface of the dielectric body at a side on which the inductive electrode is provided, so that a distance between the discharge electrode and the heater electrode is larger than that between the discharge electrode and the inductive electrode; and a shield electrode, having a connection for ground, and provided between the heater electrode and the inductive electrode on a surface of the dielectric body at the side on which the inductive electrode is provided.

2. The ion generating element as set forth in claim 1, wherein the inductive electrode is connected with a connection for ground of the shield electrode.

3. The ion generating element as set forth in claim 2, wherein the heater electrode has one end to be connected to a heater power source, and the other end to be connected with a connection for ground other than the connection for ground of the shield electrode.

4. The ion generating element as set forth in claim 1, wherein the heater electrode has one end to be connected to a heater power source, and the other end to be connected with the connection for ground of the shield electrode.

5. The ion generating element as set forth in claim 4, wherein the inductive electrode is connected with a connection for ground other than the connection for ground of the shield electrode.

6. The ion generating element as set forth in claim 1, wherein the shield electrode is line-shaped, and its both ends in a longitudinal direction each have a connection for ground.

7. The ion generating element as set forth in claim 1, wherein a distance between the shield electrode and the inductive electrode is larger than that between the discharge electrode and the inductive electrode.

8. The ion generating element as set forth in claim 1, wherein the dielectric body is made of ceramic or glass as its main component.

9. A charging device comprising:

an ion generating element recited in claim 1; and a power source section for applying the voltage between the discharge electrode and the inductive electrode, the voltage being an AC voltage.

10. An image forming apparatus comprising:

an electrostatic latent image bearing member; and a charging device for charging the electrostatic latent image bearing member;

the charging device being a charging device recited in claim 9.

11. An image forming apparatus comprising:

a transfer receiving body;

an image bearing member for bearing a toner image to be transferred to the transfer receiving body; and a pre-transfer charging device for charging the toner image, the pre-transfer charging device being a charging device recited in claim 9.

* * * * *